United States Patent [19]

Montgomery et al.

[11] Patent Number: 4,860,530

[45] Date of Patent: Aug. 29, 1989

[54] CORESPUN YARN FRICTION SPINNING APPARATUS AND METHOD

[75] Inventors: Terry G. Montgomery, Matthews, N.C.; William G. Martin, Fort Mill, S.C.

[73] Assignee: Springs Industries, Inc., Fort Mill, S.C.

[21] Appl. No.: 288,767

[22] Filed: Dec. 22, 1988

[51] Int. Cl.[4] ..... D01H 1/12; D02G 3/36

[52] U.S. Cl. ..... 57/5; 57/6; 57/224; 57/352; 57/401

[58] Field of Search ..... 57/5, 6, 12, 352, 401, 57/334, 335, 224, 315

[56] References Cited

U.S. PATENT DOCUMENTS

| | | | |
|---|---|---|---|
| 3,092,953 | 6/1963 | Blackstock | 57/12 X |
| 3,370,410 | 2/1968 | McKew et al. | 57/12 |
| 4,107,909 | 8/1978 | Fehrer et al. | 57/5 |
| 4,130,984 | 12/1978 | Lambert, Jr. | 57/315 X |
| 4,249,368 | 2/1981 | Fehrer | 57/5 |
| 4,327,545 | 5/1982 | Fehrer | 57/5 |
| 4,711,079 | 12/1987 | Newton et al. | 57/12 |

*Primary Examiner*—John Petrakes

*Attorney, Agent, or Firm*—Bell, Seltzer, Park & Gibson

[57] ABSTRACT

The present friction spinning apparatus includes a draw frame section with an entrance trumpet including first and second fiber sliver guiding passageways for forming a three component corespun yarn. One of the guiding passageways directs a core roving into the draw frame section while the other sliver guiding passageway directs a core wrapper sliver into the draw frame section so that the core wrapper fibers surround the core fibers. Wrapping fibers are then wound about the core and core wrapper fibers in an elongated throat extending between a pair of rotating suction drums.

7 Claims, 2 Drawing Sheets

CORESPUN YARN FRICTION SPINNING APPARATUS AND METHOD

FIELD OF THE INVENTION

This invention relates generally to a friction spinning apparatus and method for forming a three component corespun yarn, and more particularly to such an apparatus and method which includes a trumpet with a pair of guiding passageways for guiding a sliver and roving of fibers into the draw frame section of the apparatus so that these slivers form a core and a core wrapper of the corespun yarn.

BACKGROUND OF THE INVENTION

It is known to form a two component corespun yarn on a friction spinning apparatus. For example, U.S. Pat. Nos. 4,249,368 and 4,327,545 disclose a DREF type of friction spinning apparatus in which a single sliver of fibers is fed into the entrance end of a draw frame section and then fed through an elongated throat extending between a pair of rotating suction drums where drawn wrapping fibers are fed into the elongated throat and are wound about the fibers extending along the elongated throat to form the two component corespun yarn. U.S. Pat. No. 4,107,909 discloses a similar type of friction spinning apparatus in which a core yarn is fed into the elongated throat where drawn wrapping fibers are wrapped about and wound about the core yarn to form a two component corespun yarn. While the types of fibers making up the sliver and/or yarn fed into the draw frame section and the types of fibers making up the drawn wrapping fibers fed into the elongated throat can be varied to form two component corespun yarns with varying characteristics, the number of different types of corespun yarns which may be produced on this known type of friction spinning apparatus is limited.

SUMMARY OF THE INVENTION

With the foregoing in mind, it is an object of the present invention to provide a friction spinning apparatus and method for forming a three component corespun yarn wherein a pair of slivers of fibers is fed into the draw frame section to form a core and a core wrapper surrounding and covering the core, with an outer sheath of drawn wrapping fibers being fed into an elongated throat extending between a pair of rotating suction drums and wrapped around and surrounding the core and the core wrapper. The present apparatus and method makes it possible to produce a wide variety of different types of three component corespun yarns which were not heretofore available.

In accordance with the present invention, the friction spinning apparatus includes a trumpet positioned adjacent the entrance end of the draw frame section and including a pair of guiding passageways for guiding respective pairs of slivers of fibers into the draw frame section to form a core with a core wrapper surrounding and covering the core. As the core and core wrapper pass through the elongated throat extending between a pair of rotating suction drums, drawn wrapping fibers are fed into the elongated throat and wound about the core and the core wrapper to complete the formation of the three component corespun yarn.

The pair of guiding passageways extend through the trumpet of the friction spinning apparatus of the present invention and are preferably vertically aligned, one above the other, so that the sliver of core fibers fed through the upper guiding passageway is directed onto the top and in the center of the sliver of core wrapper fibers directed through the lower guiding passageway. The fibers are fed in this position so that the core wrapper fibers surround and cover the core fibers as they are drawn in the draw frame section and pass into the elongated throat extending between the rotating suction drums.

The trumpet is preferably molded of plastic material and includes an exit end portion having a pair of inwardly curved surfaces joined together at an outwardly extending apex. The inwardly curved surfaces substantially conform to the peripheral surfaces of the first pair of draw rolls of the draw frame section and the apex is positioned adjacent the nip of the first draw rolls in the draw frame section. The exit ends of the guiding passageways terminate at the apex of the trumpet so that the relationship of the slivers of fibers is maintained in a positive manner until the slivers of fibers are passed into the nip between the first pair of draw rolls of the draw frame section. The entrance face of the trumpet is substantially planar and is provided with an integrally molded and outwardly extending horizontal rib extending between the vertically spaced entrance ends of the guiding passageways to aid in preventing migration of fibers from one sliver to the other as they are guided into and through the trumpet.

The friction spinning apparatus and method of the present invention may be utilized to form a wide variety of different types of three component corespun yarns. For example, the present friction spinning apparatus has been used in the formation of a three component corespun yarn for forming fabric useful in the production of fire resistant safety apparel of the type disclosed in our co-pending application Ser. No. 288,682, filed Dec. 22, 1988.

The corespun yarn of this co-pending application includes a core of high temperature resistant fibers, a core wrapper of low temperature resistant fibers surrounding and covering the core, and an outer sheath of low temperature resistant fibers surrounding and covering the core wrapper. Also, the friction spinning apparatus of the present invention can be utilized in forming a three component corespun yarn in which either the same or different types of fibers can be used to form the core, the core wrapper, and the outer sheath.

BRIEF DESCRIPTION OF THE DRAWINGS

Other objects and advantages will appear as the description proceeds when taken in connection with the accompanying drawings, in which.

1, with the right-hand portion having been exposed to a flame.

DESCRIPTION OF THE PREFERRED EMBODIMENT

Figure 4:
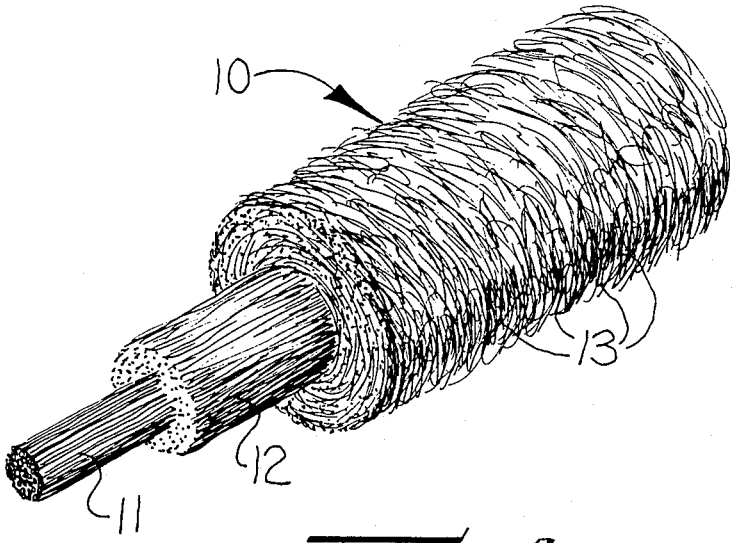
FIG. 4 is a greatly enlarged view of a fragment of a three component corespun yarn formed on the friction spinning apparatus of the present invention and illustrating portions of the outer sheath and core wrapper being removed at one end portion thereof.
Figure 5:
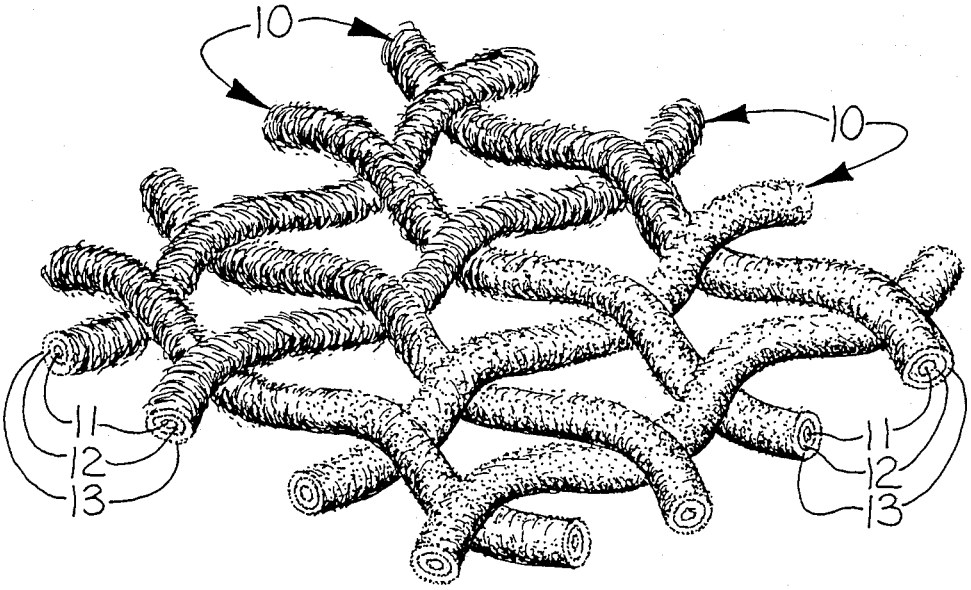
FIG. 5 is a greatly enlarged isometric view of a fragmentary portion of a fabric woven of the yarn of FIG.

One type of three component corespun yarn, broadly indicated at 10, which may be produced by the friction spinning apparatus and method of the present invention is illustrated in FIG. 4. The corespun yarn 10 includes a core 11 of fibers extending primarily in the axial or longitudinal direction, a core wrapper 12 of fibers surrounding and covering the core 11 and extending primarily in an axial direction, and an outer sheath 13 of fibers surrounding and covering the core wrapper 12 and extending primarily in a circumferential direction. The fibers of the core 11 and the core wrapper 12 enhance the tensile strength of the yarn while the fibers of the outer sheath 13 are located on the outer surface of the yarn and provide the desired appearance and general characteristics which are to be imparted to the corespun yarn 10.

Figure 1:
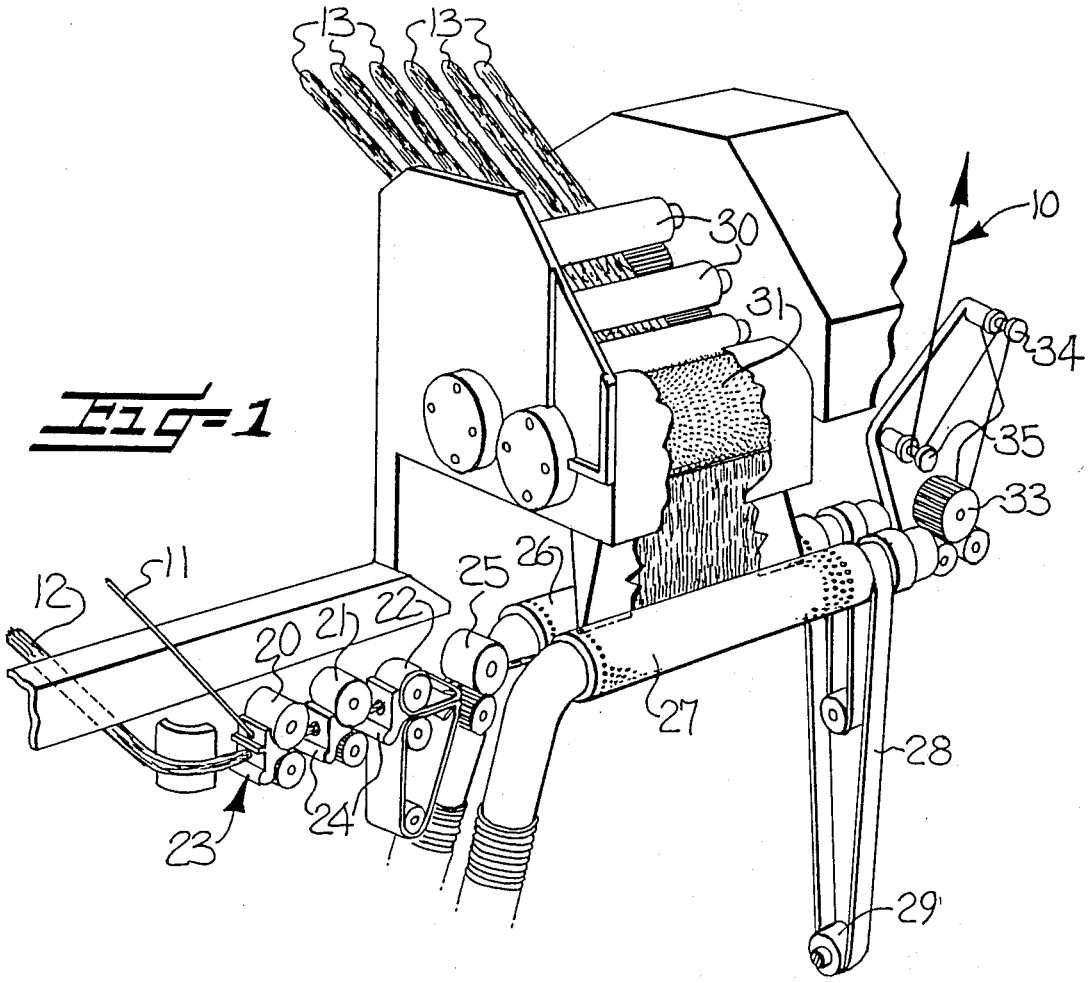
FIG. 1 is a fragmentary isometric view of a portion of the friction spinning apparatus of the present invention.
Figure 2:
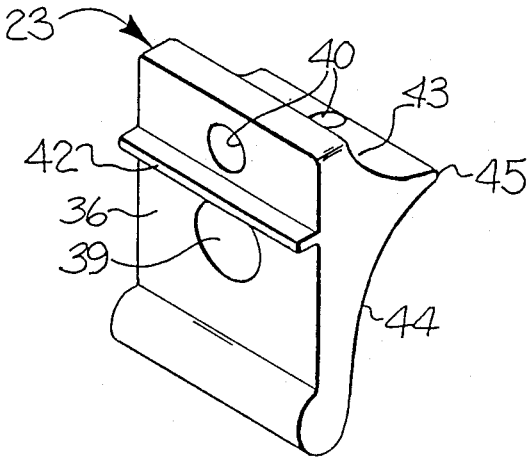
FIG. 2 is an enlarged isometric view of the entrance trumpet, removed from the spinning apparatus, and illustrating the upper and lower guide passageways formed therein.
Figure 3:
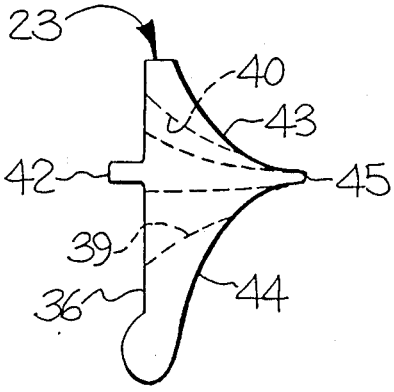
FIG. 3 is a side elevational view of the entrance trumpet shown in FIG. 2.

The corespun yarn 10 is produced on a DREF friction spinning apparatus which has been modified in accordance with the present invention, in the manner illustrated in FIGS. 1–3. The friction spinning apparatus includes a core and core wrapper drafting section having a succession of pairs of drafting or draw rolls 20, 21 and 22 with a modified type of entrance trumpet, broadly indicated at 23, positioned adjacent the nip of the first set of drafting rolls 20. Conventional trumpets 24 are positioned in the nips of the successive pairs of drafting rolls 21, 22. A set of delivery rolls 25 is provided at the exit end of the drafting section and operates to deliver and guide yarn into an elongated throat formed between a pair of perforated suction drums 26, 27 which are rotated in the same direction by a drive belt 28 and a drive pulley 29.

A plurality of sheath fiber slivers 13 is guided downwardly into draw frame rolls 30, between carding drums 31 and then fed into the elongated throat formed between the pair of perforated suction drums 26, 27 to be wrapped around the outer surface of the yarn. As the yarn leaves the exit end of the elongated throat between the pair of perforated drums 26, 27, it passes between withdrawing rolls 33 and is directed over and under yarn guides 34, 35 and to the conventional take-up mechanism of the apparatus, not shown.

As illustrated in FIGS. 2 and 3, the modified entrance yarn trumpet 23 includes a planar, vertically extending, entrance face 36, a lower yarn guide passageway 39 through which the core wrapper sliver 12 is directed, and an upper yarn guide passageway 40 through which the yarn core roving 11 is directed. The planar front or entrance face 36 of the entrance trumpet 23 is provided with an integrally formed and outwardly extending horizontal guide rib or bar 42 which serves to maintain separation of the fibers of the core roving 11 and the core wrapper sliver 12 as they move into the entrance ends of the respective guide passageways 40, 39 of the entrance trumpet 23. The exit end of the trumpet 23 is provided with inwardly curving converging surfaces 43, 44 conforming substantially to the configuration of the peripheral surfaces of the first pair of draw rolls 20. The inwardly curving surfaces 43, 44 are joined together at an outwardly extending apex 45 which is positioned adjacent the nip of the pair of draw rolls 20.

The forward or entrance ends of the guide passageways 39, 40 are vertically aligned and spaced apart below and above the guide rib 42. The exit end of the guide passageway 40 is positioned above and adjacent the exit end of the lower guide passageway 39 so that the core roving 11 is positioned on top of and in the center of the core wrapper sliver 12 as they pass between the nip of the first set of drafting rolls 20. The fibers are drawn as they pass through the succession of drafting rolls 20, 21 and 22 of the drafting section and the core wrapper sliver 12 surrounds the fibers of the core 11.

As the core wrapper 12 and the core 11 move forwardly from the delivery rolls 25 and through the friction spinning section formed by the elongated throat between the perforated rotating suction drums 26, 27, the fibers of the outer sheath 13 are wrapped around the same in a substantially circumferential direction so that the outer sheath 13 completely surrounds and covers the core wrapper 12 and the core 11. The corespun yarn 10 is then removed through the exit end of the friction spinning section by the withdrawing rolls 33 and is directed onto the take-up package, not shown.

A wide variety of different types of fibers may be utilized to form the core 11, the core wrapper 12, and the outer sheath 13. It has been found that a particularly useful three component corespun yarn can be formed on the friction spinning apparatus of the present invention by feeding a core roving 11 of high temperature resistant fibers into the upper guide passageway 40 of the trumpet 23, feeding a core wrapper sliver 12 of low temperature resistant fibers into the lower guide passageway 39, and feeding a plurality of slivers of low temperature resistant fibers 13 into the draw frame rolls 30. This three component corespun yarn is then woven or knit to form a fabric which is highly useful in the production of fire resistant safety apparel.

For example, a very effective fire resistant fabric has been formed in accordance with the following nonlimiting example. A core roving 11 comprising 40% PBI fibers and 60% Kevlar fibers, and having a weight necessary to achieve 20% in overall yarn weight, is fed into the upper guide passageway 40 of the entrance trumpet 23. A core wrapper sliver 12 comprising 100% cotton staple fibers, and having a weight necessary to achieve 30% in overall yarn weight, is fed through the lower guide passageway 39 in the entrance trumpet 23. A plurality of outer sheath slivers 13, comprised entirely of cotton fibers, is fed into the draw frame rollers 30 and in an amount sufficient to achieve 50% in overall yarn weight.

The resulting corespun yarn 10 is woven into both the warp and filling to form a 5.5 ounce plain weave fabric, of the type illustrated in FIG. 2. This woven fabric is dyed and subjected to a topical fire resistant chemical treatment, and a conventional durable press resin finish is then applied thereto. The resulting fabric exhibits durable press ratings of 3.0+ after one wash, and 3.0 after five washes. This fabric also exhibits colorfastness when subjected to a carbon arc light source of a 4–5 rating at 40 hours exposure. This fabric is then subjected to a National Fire Prevention Association test method (NFPA 701) which involves a vertical burn of 12 second duration to a Bunsen burner flame, and the fabric exhibits char lengths of less than 1.5 inches with no afterflame or afterglow. In accordance with Federal Test Method 5905, a vertical burn of two 12 second exposures to a high heat flux butane flame shows 22% consumption with zero seconds afterflame, as compared with 45% consumption and 6 seconds afterflame for a 100% Nomex III fabric of similar weight and construction. Hot air shrinkage of the corespun fabric was tested in a heated chamber at 468° F. for five minutes and shrinkage was less than 1% in both warp and filling direction.

Throughout all burn tests, the areas of the fabric char remain flexible and intact, exhibiting no brittleness, melting, or fabric shrinkage. The portion of the fabric illustrated in the right-hand portion of FIG. 2 is speckled to indicate an area which has been subjected to a burn test and to illustrate the manner in which the low temperature resistant fibers become charred but remain in position surrounding the core of high temperature resistant fibers. The charred fibers of the outer sheath 13 and the core wrapper 12 remaining in position around the core 11 provide a thermal insulation barrier and insulating air layer between the skin and the fabric, when the fabric is utilized to form a firefighter's shirt or the like.

It is to be understood that the friction spinning apparatus and method of the present invention are not limited to the production of yarn and fabric useful in the production of fire resistant safety apparel of the type set forth above but may be utilized in producing a wide variety of different types of three component corespun yarns, useful in the formation of a wide variety of different types of fabrics. The three component corespun yarns produced by the friction spinning apparatus of the present invention each includes a core 11 with the fibers extending primarily in an axial or longitudinal direction of the yarn, a core wrapper 12 of fibers surrounding and covering the core 11 and with the fibers extending primarily in the axial or longitudinal direction of the yarn, and an outer sheath 13 of fibers surrounding and covering the core wrapper 12 and with these fibers extending primarily in a circumferential direction around the corespun yarn 10. The feeding of the additional fibers to the friction spinning apparatus is made possible by the provision of an entrance trumpet which includes a pair of guide passageways for directing and maintaining the core fibers and the core wrapper fibers in the proper relationship as they are directed through the drafting section of the friction spinning apparatus.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a friction spinning apparatus for forming a corespun yarn comprising a pair of adjacent rotatable suction drums defining an elongated throat extending between said suction drums and including entrance and exit ends, a draw frame section including entrance and exit ends and with said exit end being positioned adjacent said entrance end of said elongated throat extending between said suction drums, trumpet means positioned adjacent said entrance end of said draw frame section and including a guiding passageway for guiding a sliver of fibers into said draw frame section, yarn withdrawal means positioned adjacent said exit end of said elongated throat, and roller drawing frame means including entrance and exit ends, said roller drawing frame means being positioned adjacent said elongated throat and being operable to receive slivers of fibers in said entrance end thereof and to feed drawn wrapping fibers into said elongated throat so that said wrapping fibers are wound about the fibers extending along said elongated throat, the combination therewith of means for feeding an additional sliver of fibers to said draw frame section to form a three component corespun yarn, said additional fiber feeding means comprising an additional sliver guiding passageway in said trumpet means and positioned adjacent said first sliver guiding passageway for directing the additional sliver into the central portion of the sliver passing through said first sliver guiding passageway of said trumpet means so that said first and additional slivers pass therethrough and are drafted in said draw frame section with the first sliver surrounding said additional sliver, and wherein the fibers from said roller drawing frame means are wrapped around the first and additional slivers passing through said elongated throat to form the three component corespun yarn.

2. In a friction spinning apparatus according to claim 1 wherein said trumpet means includes a planar entrance face and an exit end, said exit end including a pair of inwardly curved surfaces joined together at an outwardly extending apex, said first guiding passageway and said additional guiding passageway in said trumpet means each includes an entrance end in said planar entrance face, and an exit end adjacent said outwardly extending apex, and wherein said entrance ends are spaced apart and in vertical alignment on said planar entrance face.

3. In a friction spinning apparatus according to claim 2 wherein said exit ends of said first guiding passageway and said additional guiding passageway are positioned adjacent each other at said outwardly extending apex of said trumpet means.

4. In a friction spinning apparatus according to claim 3 wherein said planar entrance face of said trumpet means includes a horizontally extending guide bar extending outwardly from said planar entrance face and between said spaced-apart entrance ends of said first guiding passageway and said additional guiding passageway to aid in maintaining separation of the fibers of the slivers guided into and through said guiding passageways.

5. In a friction spinning apparatus according to claim 2 wherein said draw frame section includes successive pairs of draw rolls defining nips therebetween, and wherein said inwardly curved surfaces of said exit end of said trumpet substantially conform to the peripheral surfaces of the first of said pairs of draw rolls and said outwardly extending apex of said trumpet means is positioned adjacent the nip of said first pair of draw rolls.

6. A method of forming a three component corespun yarn on a friction spinning apparatus including a pair of adjacent rotatable suction drums defining an elongated throat extending between said suction drums and including entrance and exit ends, a draw frame section including entrance and exit ends and with said exit end being positioned adjacent the entrance end of said elongated throat extending between said suction drums, yarn withdrawal means positioned adjacent said exit end of said elongate throat, and roller drawing frame means including entrance and exit ends, said roller drawing frame means being positioned adjacent said elongate throat and being operable to receive slivers of fibers in said entrance end thereof and to feed drawn wrapper fibers into said elongated throat so that said wrapping fibers are wound about the fibers extending along said elongated throat, said method comprising the steps of feeding a first core roving of fibers to said draw frame section, feeding an additional core wrapper sliver of fibers to said draw frame section, and feeding a plurality of outer sheath wrapper slivers to said roller drawing frame means to wrap the drawn wrapper fibers around the core fibers and the core wrapper fibers passing through said elongated throat to form the three component corespun yarn.

7. A method of forming a three component corespun yarn according to claim 6 including trumpet means positioned adjacent said entrance end of said draw frame section, and including the steps of feeding the first core roving through one guide passageway in said trumpet means, and feeding the additional core wrapper sliver through another guide passageway in said trumpet means.

* * * * *